United States Patent [19]

Steigler et al.

[11] Patent Number: 4,616,769

[45] Date of Patent: Oct. 14, 1986

[54] DOLL HAIR MAKER AND METHOD OF USE

[76] Inventors: Thomas F. Steigler; Pamela S. Steigler, both of 800 Johnson St., Coos Bay, Oreg. 97420

[21] Appl. No.: 644,462

[22] Filed: Aug. 27, 1984

[51] Int. Cl.[4] ..... A41H 43/00

[52] U.S. Cl. ..... 223/46; 28/147; 28/149; 112/409

[58] Field of Search ..... 223/46; 112/409; 28/145, 147, 149; 139/385

[56] References Cited

U.S. PATENT DOCUMENTS

| | | | |
|---|---|---|---|
| D. 259,302 | 5/1981 | Davis . | |
| 1,750,844 | 3/1930 | Jopson | 112/409 X |
| 2,335,053 | 11/1943 | Gluck | 223/46 |
| 2,904,871 | 9/1959 | Wolff | 28/149 X |
| 3,294,124 | 12/1966 | Berger | 139/34 |
| 3,854,179 | 12/1974 | Montoya | 28/147 |
| 3,879,823 | 4/1975 | Lamb | 28/147 |
| 3,996,969 | 12/1976 | McCullough | 139/29 |
| 4,032,052 | 6/1977 | Bates, Jr. | 223/46 |

*Primary Examiner*—Werner H. Schroeder
*Assistant Examiner*—J. Olds
*Attorney, Agent, or Firm*—Henderson & Sturm

[57] ABSTRACT

An apparatus (10) for fabricating hair pieces for cloth dolls from at least one length of yarn (50), wherein the apparatus comprises a framework unit (11) rotatably disposed on a support unit (12) and adapted to accumulate a multiplicity of bunched windings of yarn, wherein a stitched seam (100) is disposed across the longitudinal orientation of the windings to create various hair piece styles.

4 Claims, 12 Drawing Figures

FIG. 1.
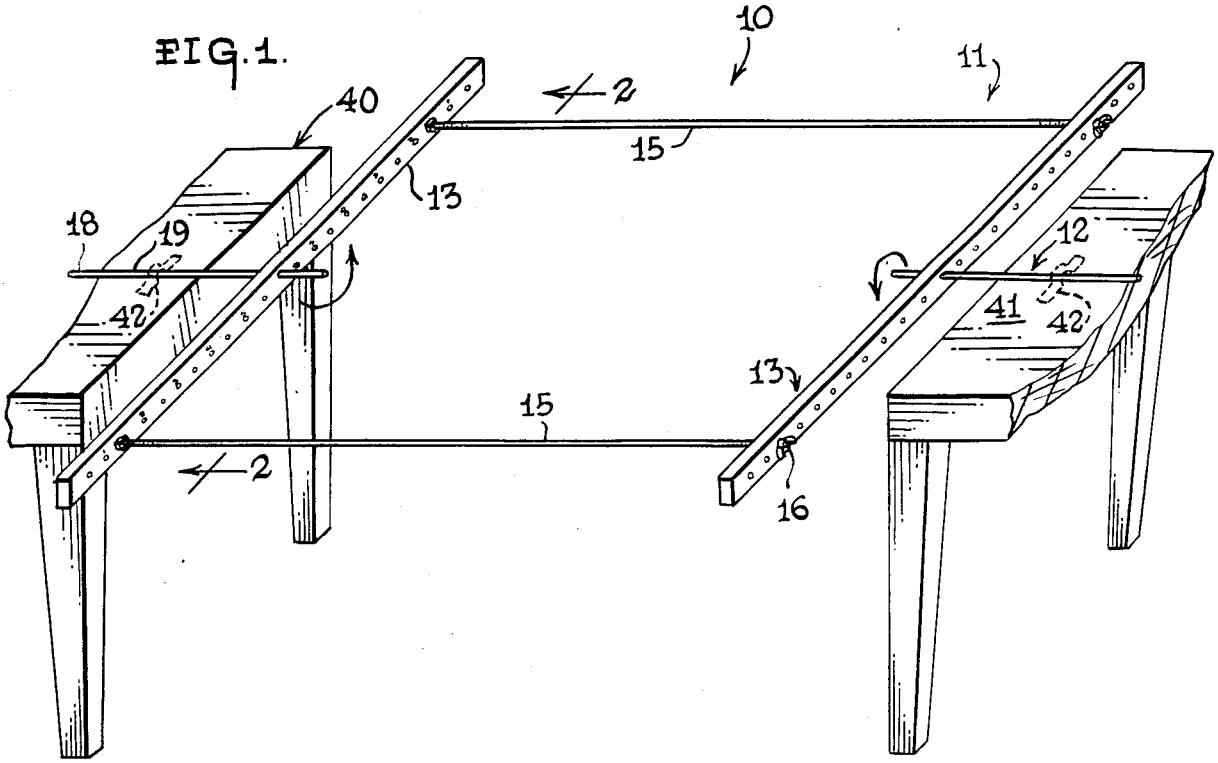
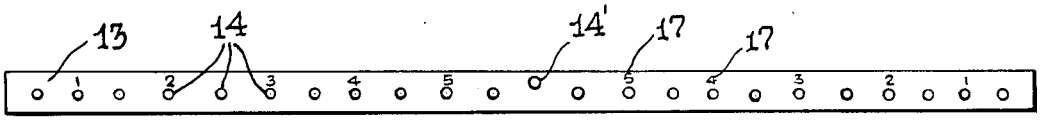
FIG. 2.
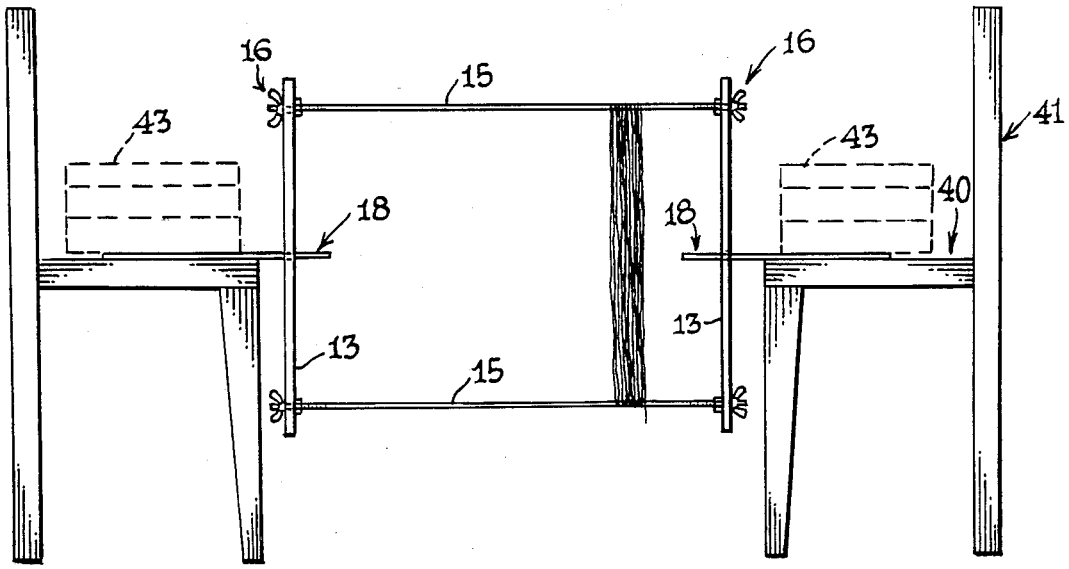
FIG. 3.

FIG. 8.
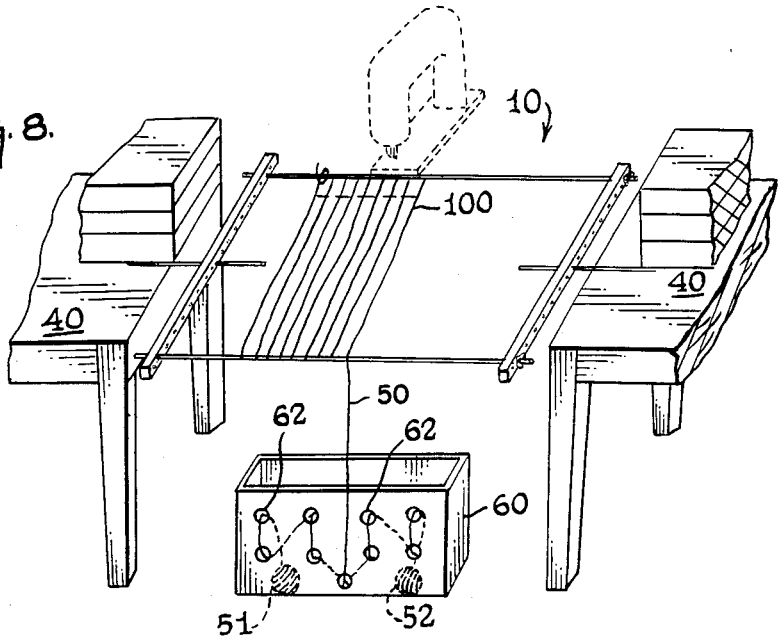
FIG. 9.
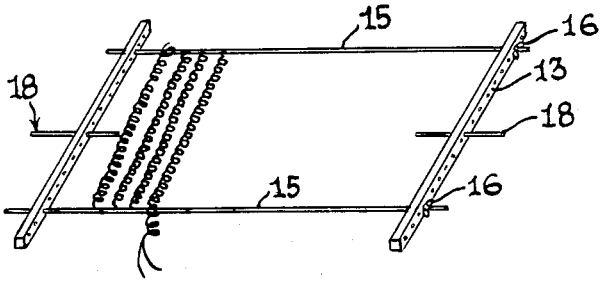
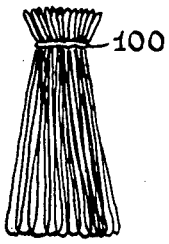
FIG. 4.
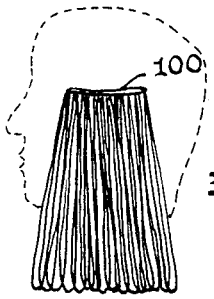
FIG. 5.
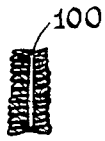
FIG. 6A.
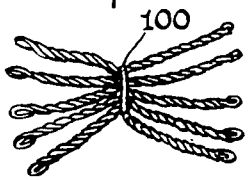
FIG. 6B.
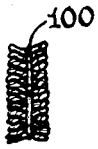
FIG. 7A
FIG. 7B.
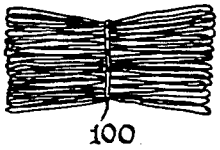
FIG. 6C.
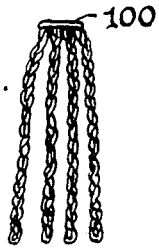

DOLL HAIR MAKER AND METHOD OF USE

TECHNICAL FIELD

This invention relates generally to the field of wig makers for dolls.

BACKGROUND OF THE INVENTION

The prior art is replete with yarn wrapping apparatus and other knitting related devices as can be seen by reference to U.S. Pat. Nos.: 3,294,124; 3,879,823; 3,996,969; and D259,302. As can be seen by a review of the above cited patents, while they are all adequate for their intended purpose, they are not particularly well suited nor adapted to accomplish the stated purpose of the present invention (i.e., doll wig making).

Up until the development of the present invention, there has not been available to the general public, an apparatus that was specifically designed to create wigs or hair pieces for cloth dolls or the like in a simple and relatively quick fashion.

In addition, none of the prior art devices either teaches or suggests the method employed in this invention to produce a variety of different hair styles (i.e., long hair with and without bangs, ringlets, and/or curls) of uniform length in a relatively short period of time.

BRIEF DESCRIPTION OF THE INVENTION

The apparatus that forms the basis of the instant invention comprises an adjustable framework unit provided with a relatively rotatable support unit that is adapted for use in conjunction with a mass of yarn, an optional yarn holder, and a sewing machine.

The adjustable framework unit comprises in general a plurality of apertured elongated primary framework members, operatively connected together by a plurality of elongated threaded rod elements. The threaded rod elements are further provided with securing means, adapted to releasably engage the rod elements in selected apertures in the framework members, to vary the spacing between the rod elements.

The relatively rotatable support unit comprises a plurality of elongated pivot elements, that are adapted to be received in centrally disposed apertures in the framework members, for rotatably suspending and supporting the framework unit between two stationary, spaced, flat support surfaces.

The general method employed to practice this invention comprises the steps of securing one end of at least one elongated length of yarn to one of the rod elements; and manipulating the at least one elongated length of yarn, while rotating the framework unit to create a multiplicity of windings of yarn on the framework unit.

Depending upon the manner in which the yarn is manipulated, various hair styles such as: long hair; long hair with bangs; curls; ringlets, etc. may be created by the selective placement of stitching, via the sewing machine, upon the accumulated windings of yarn.

BRIEF DESCRIPTION OF THE DRAWINGS

Many other objects, advantages, and novel features of the instant invention will become apparent from the detailed description of the best mode for carrying out the invention which follows, when considered in conjunction with the accompanying drawings, wherein:

FIG. 1 is a perspective view of the apparatus of the instant invention, minus the yarn;

FIG. 2 is a detail side elevational view of one of the framework elements:

FIG. 3 is a side elevational view of the apparatus in its operative position;

FIG. 4 shows a long hair with bangs wig produced by the method of this invention;

FIG. 5 shows a long hair wig produced by the method of this invention;

FIGS. 6*a* through *c*, shows various ringlet wig portions produced by the method of this invention;

FIGS. 7*a* and *b*, shows various curl configurations produced by the method of this invention;

FIG. 8 is a side elevation view of the apparatus of this invention, employed in conjunction with an optional yarn holder; and FIG. 9 is an isolated detail view illustrating one of the steps employed in the method of this invention.

BEST MODE FOR CARRYING OUT THE INVENTION

As can be seen by reference to the drawings, and in particular to FIG. 1, the apparatus that forms the basis of the instant invention is designated generally by the numeral (10). The apparatus (10) comprises in general an adjustable framework unit (11) and a relatively rotatable support unit (12). These units will now be described in seriatim fashion.

The adjustable framework unit (11) comprises in general a plurality of elongated generally rectangular framework members (13) having a plurality of aligned apertures (14) disposed at equally spaced intervals along the length of the framework memebers (13). In addition each of the framework members (13) are further provided with a centrally disposed aperture (14') which is slightly offset from the plurality of aligned apertures (14). The purpose and function of these apertures (14) and (14') will be explained shortly.

The adjustable framework unit (11) also comprises a plurality of elongated threaded rod elements (15), dimensioned to be received in selected ones of the plurality of apertures (14) in the framework members (13), and further provided with securing means (16) to complete the assembly of the framework unit (11).

As can best be seen by reference to FIG. 2, the plurality of aligned apertures (14) in the framework members (13) are equidistantly spaced from one another at discrete intervals, and at least some of the apertures (14) have indicia (17) associated with them, representative of length. In the embodiment illustrated in FIG. 2, the spacing between the apertures (14) is one-half inch, and the indicia (17) is disposed at one inch intervals; however, it is to be understood that this is for the purpose of explaining the operation of the apparatus (10) and the invention is not to be limited to the particular spacing and indicia illustrated.

As can best be seen by reference to FIG. 3, the securing means (16) comprises a wing nut and bolt arrangement; that threadingly engages the elongated threaded rod elements (15) in a well recognized manner; to secure each end of the respective rod elements (15) in a selected one of the plurality of apertures (14) in each of the framework members (13).

The relatively rotatable support unit (12) comprises a pair of pivot elements (18) in the form of elongated bars (19), that are dimensioned to be received in the centrally disposed apertures (14') of the framework members (13); for the purpose of rotatably supporting the framework unit (11) with respect to the support unit (12).

As shown in FIGS. 1 and 3, the support unit (12) is intended for use in conjunction with a plurality of elevated generally horizontal, spaced apart, independent support surfaces (40), such as are found on chairs (41) or the like. The support unit (11) is intended to be suspended and rest upon the independent support surfaces (40) and be constrained from rotation with respect thereto by means: such as adhesive tape (42) shown in phantom in FIG. 1; or heavy objects (43) such as books, etc., shown in phantom in FIG. 3. It is also necessary for the purpose of this invention that, the support unit (12) be suspended at a height sufficient to allow the complete revolution of the framework unit (11) thereon.

As shown in FIGS. 4 through 7, different types of dolls' hair styles can be fabricated from lengths of yarn (50), by using the apparatus (10) in accordance with the method steps that are about to be described. While the basic method steps are repeated for each of the hair styles created; each hair style will require slight modifications, to produce the desired end result. The method of this invention will therefore be described first in broad terms, and then in the specific steps required to produce the individual hair style illustrated.

The basic method employed with the apparatus (10) of this invention proceeds as follows: The framework unit (11) is assembled with the elongated threaded rod elements (15) being disposed in selective apertures (14) in the respective framework members (13) to produce a desired spacing between the threaded rod elements (15). The support unit (12) is operatively connected to the framework unit (11), and the assembled apparatus (10) is disposed between the independent support surfaces (40), as shown in either FIG. 1 or FIG. 3. One end of at least one elongated length of yarn (50) is then secured (as by tying) to one of the elongated threaded rod elements (15); and then the framework unit (11) is rotated with respect to the support unit (12) while the length of yarn (50) is being manually manipulated, until the apparatus (10) has a plurality of bunched yarn windings disposed thereon.

At this point the method will vary slightly for the different hair styles; however, the basic method requires that the accumulated yarn windings be joined together by a seam (100) preferably formed by a sewing machine (shown in phantom in FIG. 8), that is run transverse to the longitudinal orientation of the bunched yarn windings. Once the sewing step has been completed; the yarn loops formed by the stitched seam (100) may be optionally severed, by any conventional severing means, depending on the particular results desired.

As mentioned supra, the sewing step, and in particular the seam placement, varies depending upon the specific hair style desired. For curls: the seam placement is disposed intermediate and parallel to the original disposition of the threaded rod elements (15) on the framework members (13). For long hair with bangs: the seam placement is disposed parallel and proximate to, but spaced a distance from one of the threaded rod elements (15). For long hair: the seam placement is disposed adjacent, and parallel to one of the threaded rod elements. Once the stitching is completed, including reinforced seam stitching if desired, the short portions of the yarn on one side of the seam (100) are trimmed, as close to the seam as possible.

While ringlets follow the same basic method steps outlined above, there are additional method steps involved in their construction that bear noting. First of all ringlets require that the ends of at least two elongated lengths of yarn be secured together on one of the rod elements (15). In addition the at least two lengths of yarn (50) must be twisted together repeatedly (as depicted in FIG. 9) during each half revolution of the apparatus (10), until a multiplicity of twisted yarn windings have been accumulated on the apparatus.

The twisting of the lengths of yarn (50) presents special problems that can be avoided by the use of the optional yarn holder (60) illustrated in FIG. 8. As can be seen by reference to that drawing, the optional yarn holder (60) comprises an apertured receptacle (61) through which the individual lengths of yarn (50) from at least two separate yarn sources (51) and (52) contained within the receptacle (61) are threaded prior to the strands of yarn being twisted together. This arrangement simplified the manual twisting process required to produce ringlets, in that it produces structure that oppose the tendency of the twist in each length of yarn to migrate below, as opposed to above, the point that the manual twisting is applied.

Once the twisted lengths of yarn have been accumulated in a multiplicity of windings on the rod elements (15) the seam placement may be disposed: intermediate the rod elements to produce double ringlets as illustrated in FIGS. 7*a* and *b*, or disposed adjacent one rod element (15), to produce a single strand of ringlets, as shown in FIG. 6*c*.

It should be apparent at this stage of the specification that the end products of the method herein described are subsequently attached in any suitable manner to the head of a cloth doll (shown in phantom in FIG. 5) or the like to form a wig or hair piece therefor.

Having thereby described the subject matter of this invention, it should be obvious that many substitutions, modifications and variations of the invention are possible in light of the teachings contained herein. It is therefore to be understood that the invention as taught and described is only to be limited to the extent of the breadth and scope of the appended claims.

What we claim is:

1. An apparatus used in combination with at least one elongated length of yarn, a sewing machine and a plurality of elevated generally horizontal independent support surfaces for the purpose of creating hair pieces for cloth dolls wherein the apparatus comprises:

an adjustable framework unit comprising: a plurality of elongated generally rectangular apertured framework members having a plurality of aligned apertures disposed along their length, and at least one centrally disposed aperture intermediate said plurality of aligned apertures; a plurality of elongated rod elements adapted to be received within the apertured framework members and be secured thereto via securing means;

a relatively rotatable support unit operatively connected to the apertured framework members and adapted to suspend and rotatably support the adjustable framework unit on the generally horizontal independent support surfaces; and, means associated with said support unit to constrain the relative rotational movement of the support unit with respect to the generally horizontal independent support surfaces.

2. An apparatus as in claim 1, wherein the support unit comprises:

a pair of pivot elements dimensioned and adapted to be received within the at least one centrally disposed aperture in each of the framework elements.

3. An apparatus as in claim 2, wherein the pivot elements comprise elongated bars.

4. An apparatus as in claim 1, wherein all of said apertures are spaced at substantially equidistant intervals.

* * * * *